United States Patent [19]

Weiner

[11] Patent Number: 5,019,437

[45] Date of Patent: May 28, 1991

[54] REPAIRABLE BROADLOOM CARPET

[75] Inventor: Robert S. Weiner, Marietta, Ga.

[73] Assignee: Prince St. Technologies Ltd., Atlanta, Ga.

[21] Appl. No.: 340,637

[22] Filed: Apr. 20, 1989

[51] Int. Cl.[5] ..... B32B 33/00; B32B 27/12

[52] U.S. Cl. ..... 428/87; 428/95; 428/96; 428/97; 428/219; 428/226; 428/260; 428/262; 428/265; 428/341

[58] Field of Search ..... 428/86, 87, 95, 96, 428/97, 88, 219, 226, 260, 262, 265, 341

[56] References Cited

U.S. PATENT DOCUMENTS

| | | | |
|---|---|---|---|
| 3,359,934 | 12/1967 | Schwartz et al. | 428/96 |
| 3,402,094 | 9/1968 | Levitch | 428/88 |
| 3,864,195 | 2/1975 | Patterson | 428/95 X |
| 4,112,161 | 9/1978 | Sorrells | 428/95 |
| 4,406,310 | 9/1983 | Reader et al. | 428/85 |
| 4,556,602 | 12/1985 | Williams | 428/95 |
| 4,629,642 | 12/1986 | Kernstock | 428/95 |
| 4,916,183 | 4/1990 | Barron et al. | 524/555 |

*Primary Examiner*—Jenna Davis
*Assistant Examiner*—Terrel Morris
*Attorney, Agent, or Firm*—Salzman & Levy

[57] ABSTRACT

A broadloom carpet is featured that can be laid similar to modular carpet tiles, and which can be cut or severed to remove damaged portions or to gain access to the floor below the carpet. The carpet is uniquely characterized by its ability to prevent fraying and/or warping of severed flaps.

27 Claims, No Drawings

REPAIRABLE BROADLOOM CARPET

FIELD OF THE INVENTION

The invention features a broadloom carpet that can be adhered to a floor surface utilizing releasable adhesive for convenient installation and repair, and more particularly to a broadloom carpet comprised of synthetic fibers that will not warp or deform due to its superior dimensional stability and which provides a clean, almost "invisible edge" when cut and replaced within the carpet body, thus facilitating replacement or repair of the broadloom without there being a noticeable trace of the repair.

BACKGROUND OF THE INVENTION

In recent times, carpet has been used both indoors and outdoors. Such carpeting is usually fabricated from synthetic or man-made materials to prevent staining, increase its ability to wear and reduce its cost.

Many synthetic carpets are now being installed in the form of modular carpet tiles, of about eighteen inches square, that are adhered by pressure-sensitive, stickyback adhesives. These tiles can be quickly pressed into place upon the floor. They also provide easy access to the floor below, such as when electrical outlets need be located under the carpet.

Modular tiles have the advantages of reduced cost both in fabrication and installation, and have become very popular for applications where there is high traffic, or where repairs and/or replacement are often required.

While modular carpet tiles are very useful in the aforementioned situations, they present various disadvantageous:

a) modular carpet tiles show their demarcation lines, and do not provide the smooth flowing appearance of a broadloom carpet;

b) if patterns are set in the pile, replacement tiles will not match when repairs are made, or when the tiles are removed and replaced. The mating edges of a cut do not mechanically conform to their contiguous surfaces and the patterns do not align.

One of the objects of the present invention is to provide a carpet that further reduces the cost of tile carpets but maintains the installation convenience of the modular tile. The invention also provides the beauty characteristics of a broadloom, while improving the dimensional stability of a broadloom or tile product.

DESCRIPTION OF RELATED ART

The prior art teaches that the quality, appearance and dimensional stability of tufted fabric carpets are dependent upon the backing system. Such a teaching is illustrated in U.S. Pat. No. 3,359,934; issued to: Schwartz et al on Dec. 26, 1967. This patent describes a backing system of synthetic yarns such as polypropylene, whose backing strength is improved by a weaving technique that does not pierce or fracture the yarn.

No teaching is provided for stabilizing the backing to prevent fraying or warping when cut, nor does it provide a dimensionally stable backing that has an "invisible edge" when cut.

In U.S. Pat. No. 3,347,735; issued to: Dildilian on Oct. 17, 1967, a carpet backing system comprising primary and secondary backings of interwoven polypropylene and fiber glass adhesively bonded by latex, is shown. Dimensional stability is provided in the backing system by the strands of fiber glass, which are woven at right angles with respect to the adjacent backing.

This patent provides no teaching with respect to the replacement of portions of the damaged carpet, nor does it provide for a stable backing whose dimensional stability provides an "invisible edge" when cut.

U.S. Pat. No. 4,629,642; issued to: Kernstock on Dec. 16, 1986 teaches that a dimensionally stable carpet tile can be fabricated from glass and polyester fibers using a standard latex adhesive of about 15% latex and about 70% talc filler.

This patent does not make mention of repair and replacement characteristics of cut-away flaps.

An indoor and outdoor carpet construction is illustrated in U.S. Pat. No. 4,112,161; issued to: Sorrells. The patent depicts a synthetic backing system held together by a hot melt adhesive. The adhesive of this invention features 30% by weight of alumna trihydrate or calcium carbonate filler. Perforations allow the secondary backing to breathe, and consequentially allow the water of the floor adhesive to evaporate through the carpet.

Again no mention of repairing this carpet is to be found in the specification.

A latex bounded backing system is shown in U.S. Pat. No. 4,305,986; issued to: Hartmann et al on Dec. 15, 1981. A multi-filament, endless filament, bonded nonwoven fabric or spun bonded fabric is employed. The filament groups are generally of polyester. The bonding latex is filled with 15% by weight of chalk. Teachings of repair of this carpet are lacking in the specification.

BRIEF DESCRIPTION OF THE INVENTION

The invention is for a broadloom carpet having a backing system of synthetic fibers, but one that exhibits an improved dimensional stability. As a result of the superior dimensional stability, the carpet of this invention is characterized by its ability to be cut o severed without exhibiting any fraying at the edges of the cut. More importantly, however, the improved stiffness and reduced warpage of the inventive carpet has given rise to a unique characteristic, which can only be described as an "invisible edge". The so-called "invisible edge" of this inventive carpet structure results from the fibers that are locked in place.

When a carpet is cut in a conventional carpet, the strands or fibers that have been under a confined residual stress, suddenly spring loose, causing warping and fraying at the edge of the cut. Because of this instability, the cut pieces never properly align again with each other.

The inventive carpet locks the fibers and strands in place, such that the edge of the cut portion stays mechanically stable, and both contiguous edges will always identically match. These contiguous edges match so well, that the cut literally disappears when the contiguous edges are reunited. Thus, an "invisible edge" is created.

A repair can be made, or access to the underside of the carpet or floor can be achieved, without there being a noticeable trace of the repair. The carpet can be quickly attached to a floor or other surface utilizing a pressure-sensitive adhesive similar to the laying of modular tiles.

The carpet generally has a broadloom pile of nylon fibers, but wool or polyolefin can be used. It is woven into a primary backing comprising a flat strand woven polypropylene. A secondary backing is adhesively bonded to the primary backing and the broadloom pile.

A latex adhesive bonds the primary and secondary backings together. The latex adhesive has a special formulation that in combination with the polyester reinforcement provides the unique dimensional stability of the backing and allows the backing to be cut without causing fraying along the severed edge.

The latex adhesive is characterized by a minimum scrim delamination peel strength of approximately 5 pounds per inch and a minimum tuft binding strength of approximately 16 pounds.

Preferably, the scrim delamination peel strength is in excess of 7 pounds per inch and the tuft binding strength is in excess of 20 pounds.

Normal latex strengths are in the range of 6 to 12 pounds for the tuft binding strength, and 2.5 to 4 pounds for the scrim delamination peel strength.

The additional strength of the latex of this invention is imparted into the backing, thus providing the unique benefits of dimensional stability and edge cut integrity.

To provide additional dimensional stability to the backing system, the primary backing can be reinforced with polyethyleneterephthalate fibers for the warp strands.

The high strength, dimensionally stable, integral construction of the backing allows the carpet to be cut into flaps anywhere access is required. If the carpet is laid with pressure-sensitive, release-type adhesive, these flaps can be repeatedly lifted and replaced without any possibility of fraying, delamination or change of shape, and create the unique "invisible edge".

The latex adhesive is further characterized by a reduced calcium carbonate filler. Standard latex adhesives generally contain between 375 to 500 parts of calcium carbonate per 100 parts of latex base material. The latex of the invention has only about 110 parts of filler per 100 parts of the latex base comprising rubber solids of carboxylated styrene butadiene.

DETAILED DESCRIPTION OF THE INVENTION

The carpet of the invention features a novel backing system that allows:

1) access under the carpet; and
2) allows for the replacement of locally damaged portions without a noticeable trace of the repair.

Typical specifications for the carpet of this invention is presented in Tables I and II below:

TABLE I

| SPECIFICATIONS | |
|---|---|
| Surface: | Tweed cut and uncut textured pattern (color diffused) |
| Face Yarn: | Monsanto Ultron 3D 4th generation soil hiding nylon with permanent static control |
| Tufted Yarn Weight: | 35 ounces |
| Pile Height: | .21" |
| Backing System: | A broadloom carpet backing system that affords access to the floor after installation. It has an integral, high strength, dimensionally stable construction that allows face cutting the carpeting into flaps or removable pieces that can be picked up and replaced repeatedly without any carpet degradation. There is absolutely no yarn drop-off, edge fraying, delamination or change in size or shape. Can be installed using standard broadloom procedures with a releasable gluing system. The backing system consists of a polyester reinforced (for dimensional stability) closed weave polyolefin fabric containing static reducing fibers coupled with a composite of enriched SBR latex and leno woven polyolefin. |
| Backing System Weight: | 47 ounces |
| Total Weight: | 83 ounces |

TABLE II

| SPECIFICATION | |
|---|---|
| Surface: | Cut and loop pile textured pattern |
| Face Yarn: | BASF Zeftron solution dyed soil hiding nylon with permanent static control |
| Tufted Yarn Weight: | 33 ounces |
| Pile Height: | .3" |
| Gauge: | 3/32 |
| Stitches Per Inc: | 10.5 |
| Backing System: | A broadloom carpet backing system that affords access to floor after installation. It has an integral, high strength, dimensionally stable construction that allows face cutting the carpeting into flaps or removable pieces that can be picked up and replaced repeatedly without any carpet degradation. There is absolutely no yarn drop-off, edge fraying, delamination or change in size or shape. Can be installed using standard broadloom procedures with a releasable gluing system The backing system consists of polyester reinforced (for dimensional stability) closed weave polyolefin fabric containing static reducing fibers coupled with a composite of enriched SBR latex and leno woven polyolefin. |
| Backing System Weight: | 47 ounces |
| Total Weight: | 80 ounces |

The latex which is a cabroxylated styrene butadiene can be purchased from Polymer Products, Dalton, Ga. having the formula No. 9365, and which contains a 110 parts filler (calcium carbonate) per 100 parts of the rubber solids.

The following Table III is a bulk composition of the latex adhesive of this invention:

TABLE III

| | |
|---|---|
| Base 69741 | 9560 lbs Styrene Butadiene |
| Whitening Filler | 8175 lbs Calcuim carbonate |
| Frothing Aid | 55 lbs Soap |
| P178 Thickner | 210 Gum |

Then add X2A Dye 2 parts dry to 150 parts load
Total solids = 759%: 18,000 lbs batch Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described this invention, what is desired to be protected by Letters Patent is presented in the subsequently appended claims.

What is claimed is:

1. A broadloom carpet having a backing system comprising synthetic fibers, and which substantially exhibits an "invisible edge" when cut, said broadloom carpet including:

a broadloom pile;

a primary backing supporting said broadloom pile comprising synthetic fibers;

a secondary backing that comprises synthetic fibers and which is adhesively bonded to said primary backing to provide said primary backing with added stiffness, said secondary backing being coatable with a pressure-sensitive adhesive to allow said broadloom carpet to be layed upon a floor in a manner similar to laying of floor tile, said primary and secondary backing being further characterized by a total weight per square yard of approximately 47 ounces; and a latex adhesive for bonding said primary and secondary backings that is characterized by a minimum scrim delamination peel strength of approximately 5 pounds per inch and a minimum tuft binding strength of approximately 16 pounds.

2. The broadloom carpet of claim 1, wherein said primary backing comprises a flat strand woven polypropylene.

3. The broadloom carpet of claim 2, wherein said woven polypropylene comprises strands of polyethyleneterephthalate.

4. The broadloom carpet of claim 3, wherein said strands of polyethylene terephthalate are disposed in a warp portion of said backing.

5. The broadloom carpet of claim 3, wherein said secondary backing comprises woven strands of polypropylene.

6. The broadloom carpet of claim 2, wherein said secondary backing comprises woven strands of polypropylene.

7. The broadloom carpet of claim 5, wherein said secondary backing is leno woven.

8. The broadloom carpet of claim 6, wherein said secondary backing is leno woven.

9. The broadloom carpet of claim 1, wherein said latex adhesive has a minimum scrim delamination strength of 7 pounds per inch and a minimum tuft binding strength of 20 pounds.

10. The broadloom carpet of claim 5, wherein said broadloom pile comprises tufts of nylon.

11. The broadloom carpet of claim 1, wherein said broadloom pile comprises tufts selected from a group consisting of nylon, wool and polyolefin.

12. A broadloom carpet having a backing system comprising synthetic fibers, and which is further characterized by its ability to be cut without exhibiting fraying at edges about said cut, wherein portions thereof can be repeatedly lifted or replaced after said carpet has been adhered to a floor surface without a noticeable trace of said cut, said backing system characterized by a total weight per square yard of approximately 47 ounces, and comprising a primary and secondary backing of synthetic fibers that are adhesively bonded with a latex containing approximately 110 parts filler for every 100 parts of latex rubber solids, said latex being further characterized by a minimum scrim delamination peel strength of approximately 5 pounds per inch and a minimum tuft binding strength of approximately 16 pounds.

13. The broadloom carpet of claim 12, wherein said filler comprises calcium carbonate.

14. The broadloom carpet of claim 12, wherein said primary backing comprises a flat strand woven polypropylene.

15. The broadloom carpet of claim 14, wherein said woven polypropylene comprises strands of polyethyleneterephthalate.

16. The broadloom carpet of claim 15, wherein said strands of polyethyleneterephthalate are disposed in a warp portion of said backing.

17. The broadloom carpet of claim 15, wherein said secondary backing comprises woven strands of polypropylene.

18. The broadloom carpet of claim 14, wherein said secondary backing comprises woven strands of polypropylene.

19. The broadloom carpet of claim 17, wherein said secondary backing is leno woven.

20. The broadloom carpet of claim 18, wherein said secondary backing is leno woven.

21. The broadloom carpet of claim 12, wherein said latex adhesive has a minimum scrim delamination strength of approximately 7 pounds per inch and a minimum tuft binding strength of approximately 20 pounds.

22. The broadloom carpet of claim 17, wherein said broadloom carpet has a pile which comprises tufts selected from a group consisting of nylon, wool and polyolefin.

23. The broadloom carpet of claim 12, wherein said broadloom carpet has a pile which comprises tufts selected from a group consisting of nylon, wool or polyolefin.

24. A broadloom carpet that can be adhered to a floor surface in similar fashion to that of modular carpet tiles, and which is characterized by its dimensional stability and its resistance to fraying about cut edges whereby portions thereof can be repeatedly lifted or replaced with a substantially "invisible edge" after adherence to a floor surface with a pressure-sensitive adhesive, said broadloom carpet comprising a pile backed by a primary and secondary backing characterized by a total weight per square yard of approximately 47 ounces, and having polypropylene fibers adhesively bonded to each other by a latex adhesive having a minimum scrim delamination strength of approximately 5 pounds per inch, and a minimum tuft binding strength of at least approximately 16 pounds.

25. The broadloom carpet of claim 24, wherein said latex adhesive has a minimum tuft binding strength of approximately 18 pounds.

26. The broadloom carpet of claim 24, wherein said latex adhesive comprises approximately 110 parts of filler for every 100 parts of latex rubber solids.

27. The broadloom carpet of claim 26, wherein said filler comprises calcium carbonate.

* * * * *

UNITED STATES PATENT AND TRADEMARK OFFICE

CERTIFICATE OF CORRECTION

PATENT NO. : 5,019,437

DATED : May 28, 1991

INVENTOR(S) : Robert S. Weiner

It is certified that error appears in the above-identified patent and that said Letters Patent is hereby corrected as shown below:

On the title page, item [73] Assignee: delete Prince St. Technologies Ltd., and substitute therefor-- PRINCE ST. HOLDING CO.--

Signed and Sealed this

Twenty-second Day of December, 1992

*Attest:*

DOUGLAS B. COMER

*Attesting Officer*

*Acting Commissioner of Patents and Trademarks*